United States Patent [19]

Coucher et al.

[11] 4,183,974

[45] * Jan. 15, 1980

[54] CONTAINER COATING METHOD

[75] Inventors: Robert G. Coucher; Gene Gerek, both of Salt Lake City, Utah

[73] Assignee: W. R. Grace & Co., Cambridge, Mass.

[ * ] Notice: The portion of the term of this patent subsequent to May 24, 1994, has been disclaimed.

[21] Appl. No.: 780,607

[22] Filed: Mar. 24, 1977

Related U.S. Application Data

[63] Continuation-in-part of Ser. No. 430,094, Jan. 2, 1974, Pat. No. 3,962,486, and a continuation-in-part of Ser. No. 486,464, Jul. 8, 1974, Pat. No. 3,947,617, and a continuation-in-part of Ser. No. 526,735, Nov. 25, 1974, Pat. No. 4,025,664, and a continuation-in-part of Ser. No. 558,787, Jun. 20, 1975, abandoned.

[51] Int. Cl.[2] ..... B05D 7/22; B05D 3/02

[52] U.S. Cl. ..... 427/28; 427/181; 427/183; 427/195; 427/233; 427/234; 427/236

[58] Field of Search ..... 427/28, 181, 183, 195, 427/231, 233, 234, 236, 239; 118/622, 308, 317

[56] References Cited

U.S. PATENT DOCUMENTS

| | | | |
|---|---|---|---|
| 2,927,044 | 3/1960 | Gough | 427/233 |
| 3,058,443 | 10/1962 | Paton | 118/622 |
| 3,422,795 | 1/1969 | Smith | 118/622 |
| 3,697,313 | 10/1972 | Stumphauzer | 427/233 |
| 3,726,711 | 4/1973 | Hogstrom | 427/233 |
| 3,745,035 | 7/1973 | Troughton et al. | 427/181 |
| 3,815,535 | 6/1974 | Becker et al. | 427/239 X |
| 3,896,602 | 7/1975 | Petterson | 113/120 A X |
| 3,903,321 | 9/1975 | Schaad | 427/27 |
| 3,904,930 | 9/1975 | Waldron | 427/28 |
| 4,025,664 | 5/1977 | Gerek et al. | 427/181 X |

*Primary Examiner*—Shrive P. Beck
*Attorney, Agent, or Firm*—Trask & Britt

[57] ABSTRACT

A method for coating a cylindrical container with a thin, resinous coating by spraying powdered resin is disclosed. The technique involves spraying of finely divided resin particles into a beverage container from spray nozzles external to the container. The container may be sprayed by directing a pulse of a predetermined quantum of resin into the container to deposit a substantially uniform coating. Alternatively, a continuous flow of resin at a predetermined rate may be sprayed into a container. The resin particles are caused to adhere to the container by preheating the container. The coating is rendered continuous by preheating the container to temperatures above the softening point of the resin. Postheating of the coated container at temperatures in excess of about 300° F. matures the coating.

29 Claims, 13 Drawing Figures

CONTAINER COATING METHOD

RELATED APPLICATIONS

This application is a continuation-in-part of copending applications Ser. Nos. 430,094, filed Jan. 2, 1974, (now U.S. Pat. No. 3,962,486); 486,464, filed July 8, 1974 (now U.S. Pat. No. 3,947,617); 526,735, filed Nov. 25, 1974 now U.S. Pat. No. 4,025,664; and 558,787, filed June 20, 1975 (now abandoned, refiled as Ser. No. 814,455, filed July 11, 1977).

The parent applications disclose and claim various procedures for applying resinous powders to the interior surface of containers and thereafter, or in conjunction therewith, curing the applied resin into an ultra thin, substantially continuous film coating. The present application discloses and claims procedures especially preferred for producing less expensive coatings on the interior surfaces of containers (e.g., beer cans) which require less of a barrier than do typical food and beverage containers. Many of the procedures disclosed herein have application in processes productive of "barrier" coatings, however.

BACKGROUND OF THE INVENTION

Small-mouthed, thin-walled metal containers are utilized for many purposes, most predominantly for commercial distribution of food and beverages. These containers are commonly called "tin cans". Although it is not a widely known fact, almost all "tin cans" used for food and beverage purposes are coated on the interior with a thin, i.e., a thickness less than about one mil, comestible (food grade) resinous coating. Millions of pounds of resin are utilized each year in coatings for food and beverage containers. These organic resinous coatings, which may vary in composition dependent upon the ingredient which they will contact, are necessary to prevent contamination of the food or beverage by the metal container, whether said container is tin plated steel or aluminum. Contamination of food and beverage by the metal container generally affects flavor, occasionally makes the food or beverage unwholesome, and frequently affects appearance. Also, the coating promotes the shelf life of the "canned" ingredients.

A number of different resinous compositions have been utilized with success as coatings for metallic containers, particularly food and beverage containers. Although water-based coatings have been available for a number of years, the films or coatings resulting therefrom have not been satisfactory for food and beverage containers; for example, beer develops unacceptable taste when stored for normal durations in metal containers coated with a water-based resinous coating.

The mainstay of the can coating industry has been organic, solvent-based coatings—in spite of the fact that the solvent, which evaporates upon application of the coating, is 80% of the weight of the material and often has a greater cost than the resin which remains on the container. Organic, solvent-based coatings have been successful, however, because thin coatings can be applied to metal containers which do not affect substantially the taste of the food or beverage. Solvent-based coatings, however, have a very distinct disadvantage—a very large quantity of solvent evaporates into the atmosphere adjacent container coating facilities. These organic solvents are generally noxious and frequently toxic.

One approach towards eliminating solvents from container coatings is to use 100% solids coating systems; e.g., the liquid styrene-polyester system, epoxy resins and the like. Liquid systems containing 100% coatings solids; i.e., everything in the liquid system reacts or interacts to become an integral part of the resinous (polymeric) coating formed upon a substrate, have severe limitations in that few polymeric systems lend themselves to a liquid system wherein one of the reactants is dissolved in another reactant. Also, those 100% solids liquid systems available have such high viscosities that applications by spray techniques is impracticable, if not impossible, especially when thin films are desired. A further limitation of 100% solids coatings for containers is the inclusion in the coating of a certain quantity of monomer or low molecular weight polymer which, even when present only as parts per million, produces odor and usually contributes taste to the coating.

Another type of 100% solids coating material is a powdered, resinous material. "Powder coatings", as the term is commonly used, have been applied to objects primarily by fluid bed and electrostatic spray techniques. Fluid bed techniques are unsatisfactory to coat food and beverage containers since such techniques coat both the interior and exterior of the can, thereby consuming an uneconomical amount of resin. Also, coatings formed in a fluid bed tend to be relatively thick; e.g., five mils and greater. Electrostatic spray techinques work very well for most objects, although coatings less than one mil thick are difficult to obtain.

However, electrostatic spray principles (a charge on the powder and an opposite charge on the object to be coated) do not work when the interior of a small cylindrical metal container is to be coated. An effect known as the "Faraday Cage Effect" occurs when powder containing an electrostatic space charge is propelled towards the interior of an oppositely charged metal cylindrical container having one end thereon, resulting in formation of a partial coating.

A further impediment to replacement of solvent-based coatings for containers, aside from the difficulties encountered in making very thin, pore-free films, has been the coating speed required by industry. Commercial container lines, particularly beverage container lines, move at a speed of 250 to 300 containers per minute.

DESCRIPTION OF THE DRAWINGS

The invention is illustrated by the attached figures wherein.

DESCRIPTION OF THE INVENTION

Figure 1:
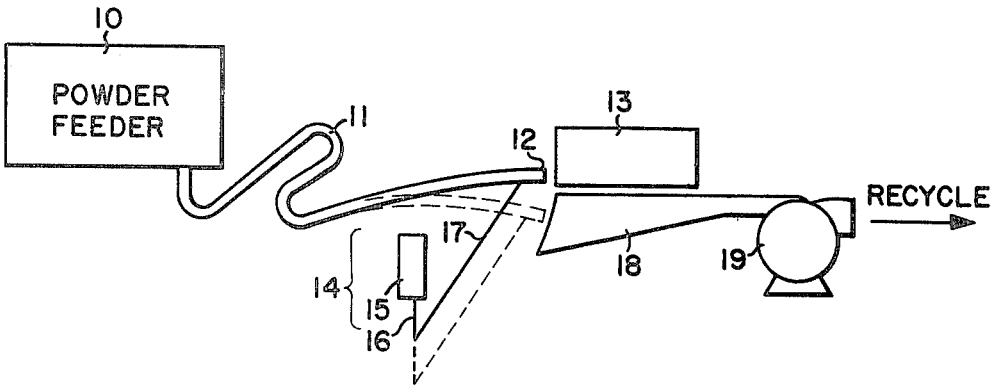
FIG. 1 is a schematic illustration of a continuous container coating apparatus.

A process has now been invented whereby an ultra-thin, substantially uniform resinous coating can be applied to the interior of a container, particularly a cylindrical, metal container having a length substantially greater than its diameter. Coatings may be readily applied at a thickness of less than 1 mil, and coatings having a thickness less than 0.5 mil and as thin as about 0.2 mil to about 0.05 mil and less having an electrical conductivity through the film of less than about 75 milliamps are feasible.

Coatings for containers, especially containers utilized in the food industry, have certain criteria which must be met, including thinness (for economic reasons), inertness, impermeability, nonabsorptiveness and adherence. Coatings having these characteristics have traditionally been difficult to apply to two-piece containers. Solvent systems have been applied by a probe, although this technique is slow, having a maximum coating rate of 150 containers per minute. Solvent systems applied externally to the container tend to wash the coating off the dome of the closed end, frequently requiring an extra heavy coating on the closed end. Coatings meeting these criteria can be applied by the techniques of the instant invention.

The process by which ultra-thin coatings are obtained on the interiors of slender, cylindrical containers comprises generally:

(a) preheating at least the bottom of the container to a temperature in excess of the softening point of the resin particles, generally at least 150° F. The sidewalls of the container are desirably maintained at temperatures near but below the softening point of the resin when tribo-electric charge is relied upon for resin distribution. The process is operable with sidewall temperatures near room temperture (e.g. 80° F.). When the entire can is heated to above the melting point of the resin, usually 250° F. or more, can rotation is desirable for resin distribution;

(b) spraying into the interior of the container from a location outside of the container a predetermined quantum of finely divided resin particles, (generally the particles are a thermoset resin having a softening point less than 150° F.), sufficient to coat the container interior with a continuous fim. The resin is entrained in a gas stream traveling at a velocity sufficient to project the resin particles to the bottom of the container, preferably with the gas stream collimated around the axis of the container; and (c) forming the gas and entrained resin powder into a cloud-like spray pattern to assure coverage of the moat portion and walls of the containers after the collimated mixture strikes the bottom of the can.

The process works well with thermoplastic resin particles whereby the container is preheated to a temperature above the softening point of the resin which is generally above about 300° F. for thermoplastic resins.

The various details of the process employed in achieving ultra-thin coatings on the interior of slender, cylindrical containers are now described.

Preheating

The cylindrical container is heated to a temperature in excess of the softening point of the resin to be applied, generally at least 225° F. and preferably at least 300° F. with useful temperatures ranging from about 150° F. up to the metallurgical limits of the container, which depend upon wall thickness and construction material, e.g., a maximum temperature of about 525° F. exists for the very thin walled aluminum containers typically used as beverage containers while temperatures of up to about 1000° F. are safely used with steel walled containers.

Hot air ovens, electric and gas ovens, electric resistance, plasma arc flames and combustion type flames can be utilized effectively to preheat the container.

Hot air ovens are generally available in most container coating plants since solvent coating techniques heretofore employed have required such ovens to drive off the solvent from the coating and to cure coatings of the thermosetting type. Such ovens typically have the ability to heat their contents to temperatures in excess of 450° F. Solid resin particles may be sprayed into containers immediately after the container leaves the oven or even in the oven through the use of a water-cooled spray nozzle. Spraying the container in the oven has the advantage of precluding any cooling of the container between the preheating and spraying stage and of providing heat to the container for curing or maturing the resin after spraying.

Electric resistance heating of the container may be practiced. A pair of electrodes are attached at opposite ends of a container to cause electricity to flow through the container, which acts as a resistor, thereby increasing in temperature.

Combustion type flames may also be utilized to heat the container. An oxyacetylene flame, for example, rapidly heats the container to temperatures in excess of the minimum coating temperature. Care must be exercised in operating the oxyacetylene torch to avoid operating either a strongly reducing or strongly oxidizing flame.

When it is desired to obtain a "barrier" coating (minimum thickness of about 0.2 mils), the preheating is preferably conducted so that the container is substantially uniformly heated, i.e., so that the whole container is at substantially the same temperature. A uniform container temperature aids the particles in adhering uniformly and in causing the film to mature uniformly. Furthermore, uniform heating is desired to avoid hot-spots exceeding the metallurgical limits of the container when the container is heated to temperatures near the upper metallurgical limits of the container. In certain applications, notably the coating of two piece aluminum beer cans, the minimum achievable thickness which remains "continuous" is desired for reasons of economy. Uniform thickness is not essential. In those cases, the bottom of the can may be heated to a temperature comparable to the uniform heating modes, so that adequate coating of the moat region is assured. The side walls may be maintained at lower temperatures, however, resulting in thinner films in those regions.

The cooling rate of the container can be slowed by several techniques, for example, the ambient temperature can be raised, thereby providing a smaller ΔT. The ambient temperature can be raised by placing the sprayed container in an insulated chamber having a temperature above the usual ambient. An insulated chamber having a temperature of 225° F. to 300° F. slows the cooling rate of a container preheated to 425° F. to cause the coating therein to fully cure by the time the temperature of the container has dropped to about 225° F. to 300° F. Alternatively, the temperature of the container may be maintained sufficiently high, e.g., above about 350° F. for a period sufficient to cause the coating to cure by heating the container very briefly to a temperature of about 400° F. to about 425° F., within a short time, e.g., 50 to 500 milliseconds after the container is sprayed. For example, the container, after being sprayed, can be heated to about 425° F. in about 100 milliseconds, or less, by a plasma arc generated flame.

In practice, the degree to which cooling is retarded depends upon the coating being applied. Typical thermoset resinous coatings require exposure for a limited period of time at a temperature at or above the curing temperature of the resin. Typical epoxy resins useful in coating containers, e.g., Epon 1004, require a residence time of about one to three minutes at a temperature of about 350° F. to effect curing of the coating. At temperatures above the minimum curing temperature, the curing proceeds more rapidly, but a minimum period of about one minute is required. Heating the coated container to temperatures substantially in excess of the minimum curing temperature insures that a temperature at least equal to the curing temperature will be experienced for a period sufficient to cause the coating to cure.

When preheating of the containers is to temperatures below which the resin "gels", i.e., below about 250° F., it is not as important to subject the coatings to curing temperatures immediately after application. Accordingly, the curing step may be effected at a remote time or location. Conservation of heat is also less of a factor. Curing can be done in a very short time (e.g. 20 seconds) compared to water and solvent systems (typically 2 minutes) because no precuring step is required (due to the absence of volatile solvents in the coatings of this invention).

Thermosetting resins are generally low molecular weight polymers which cure by cross-linking to form a very high molecular weight polymer. The viscosity of a thermoset resin decreases as temperature increases until gellation occurs; thereafter, viscosity increases as temperature increases. The melt viscosity of a typical thermosettable resin useful as a coating material, e.g., Epon 1004, is illustrated in FIG. 5.

At point A the resin is at its softening point. As the temperature increases, the resin viscosity decreases until the lowest melt viscosity is achieved at point B. With further increase in temperature, viscosity increases until gellation occurs, thus gellation occurs between points B and C. After gellation occurs, the resin cannot be reflowed, i.e., the particular shape or physical condition of the resin cannot thereafter be altered by any means without destroying the integrity of the resin.

Figure 5:
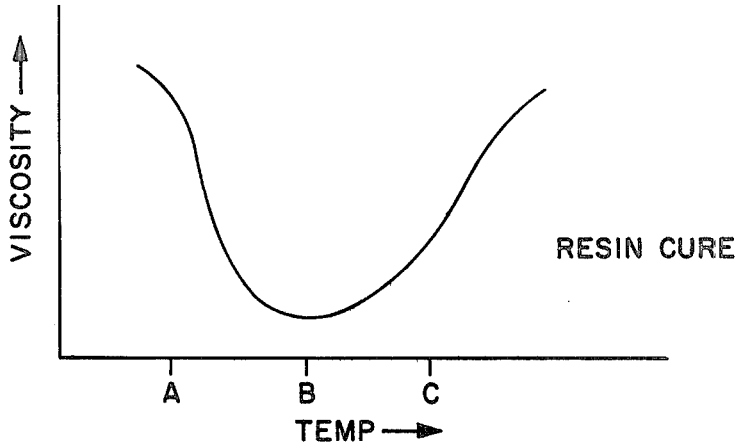
FIG. 5 graphically represents the relationship between viscosity and temperature of a typical thermoset resin.

In utilizing thermosetting resins in the instant invention, it is required to apply the resin particles to a container having a temperature above the softening point of the resin and preferably at about point B on the viscosity curve, FIG. 5, i.e., above the temperature at which the resin is least viscous so that optimum flow of the resin particles into an impervious, continuous film is achieved. Film uniformity is enhanced by spraying the resinous particles into a container which is at or near the lowest melt viscosity temperature of the resin. At a temperature of 350° F., for example, a typical epoxy resin such as Epon 1004 (plus dicyanamide catalyst) adheres and gels within 50 milliseconds. Epon 1004 is a proprietary polymer of Shell Chemical Company, Houston, Tex.

Applying the resin particles at temperatures above the gel point is also preferred inasmuch as the resin particles will flow into an impervious, continuous film and gel in such a state so that very little additional energy is required to cure the resin to a full cured state having maximum properties as a protective film. If the temperature of the container is sufficiently above the gel point to provide thermal energy to the coating to raise it to the gel point without having the temperature of the system drop below the gel point, gellation of the resin will occur. After gellation is initiated, if the thermal energy possessed by the container is sufficient to maintain the temperature of the coating above the gel point for at least one minute and preferably for about two minutes, unless a very fast curing resin is utilized, the coating will become fully cured.

It is apparent that the technique of imparting a substantial amount of thermal energy required to gel the thermosetting resinous coating, or even to bring about full cure by preheating the container to elevated temperatures, is significant since only one energy input station is required, or at least if a second energy input station is required, only a small amount of energy need be imparted at such second station. A second advantage, of course, to having the resin gelled, or even cured, shortly after spraying is that the coating is durable and cannot be dislodged in the manner of an electrostatic coating which adheres merely as electrostatically charged particles until passed through an oven or other device to impart a substantial amount of thermal energy thereto.

Thin walled containers, especially aluminum containers, lose heat rapidly, e.g., at 450° F. a thin walled aluminum container drops approximately 300° F. in about four seconds. Thus, it is necessary to spray a container promptly after preheating to avoid an undue energy loss and perhaps even have the substrate temperature lower than the minimum to achieve an adherent coating. Also, it is preferred to insulate the container after spraying to preserve the thermal energy present in the container.

The techniques described herein for application of a thermosetting resinous coating are useful also for applying thermoplastic resinous coatings although the behavior of the resin may be different. A thermoplastic resin decreases in viscosity as temperature increases, thus, generally, the flowability of the resin improves as temperature increases. Therefore, thermoplastic resins must be selected which have good coating protective properties at the temperature of use but have sufficiently low flow point to be practicably applied. Higher minimum preheat temperatures, e.g., generally above 400° F., are required to achieve good thermoplastic films in contrast to the lower temperatures useful for thermoset resins. Typical thermoplastic resins include nylon, thermoplastic epoxide and phenoxide resins having molecular weights of about 20,000 to about 200,000, polypropylene, polyethylene and the like.

The technique of providing sufficient thermal energy in the container to cause the resin particles to adhere and form a continuous film on a can works best when very thin films are applied, i.e., films less than about 0.5 mil thick, so that the quantity of thermal energy to raise the coating to the curing temperature and to initiate curing is not greater than the energy present in the container.

Rotation of Container

One method for distributing powdered resin across the internal surfaces of a container is to rotate the containers. This expedient is used to advantage with the containers heated uniformly as previously described. It is particularly advantageous when the can walls are heated to above the melting point of the resin.

As illustrated in FIG. 1, a slender, cylindrical, two-piece container is sprayed with finely divided resin particles while being rotated. Although various rotational speeds are effective, the minimum rotational speed preferred is one sufficient to create centrifugal forces adequate to distribute the resin. Although this may vary depending upon the diameter of the container, for the common container designed to hold 12 fluid ounces, which has a diameter of about 2½ inches, a minimum rotational speed of about 500 rpm is desired and a rotational speed of above about 700 rpm is preferred. Rotational speeds up to 5000 rpm may be used.

Best coating results are achieved when the rotational speed is from about 1000 rpm to about 2500 rpm. Since it is an objective of the instant invention to provide ultra-thin coatings for container interiors which will meet the standard of the beverage industry, the coatings should have a substantially uniform thickness. Otherwise, areas which have insufficient coating thereon will fail.

Figure 6:
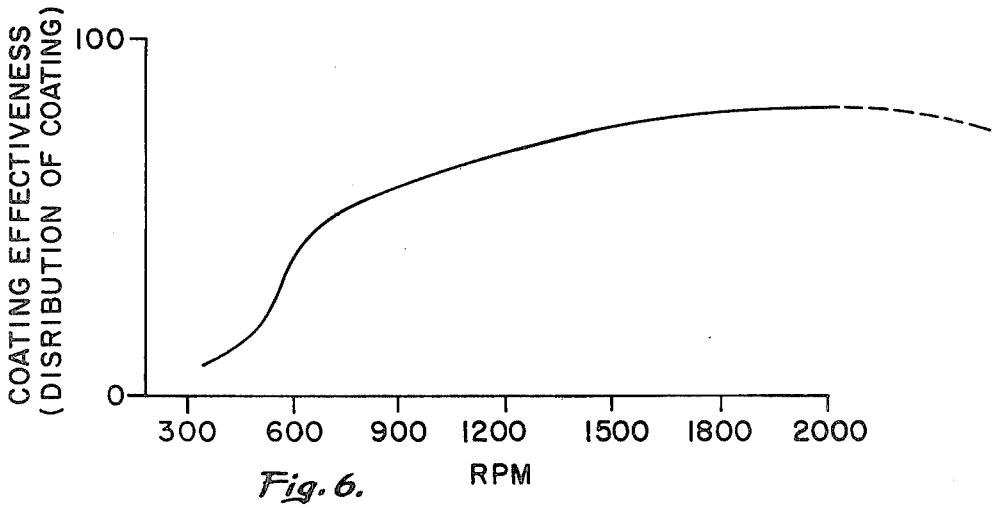
FIG. 6 graphically represents the relationship between coating effectiveness and the rate of revolution of a container being coated.

Coating distribution, i.e., uniformity of film thickness, can be altered by varying the rotational velocity of the container being sprayed. As illustrated in FIG. 6, the uniformity of the coating increased with increasing rotational velocity for a given set of spray conditions.

The rotational velocity of the container and the spraying conditions, i.e., spray duration, are interrelated inasmuch as a minimum of two revolutions during the period the resin is being sprayed appears to give best results. Thus, for a resin spray duration of about 100 milliseconds, a minimum rotational velocity of about 1200 rpm is preferred.

Figure 3:
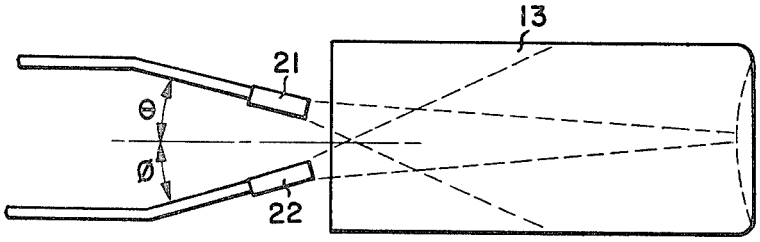
FIG. 3 illustrates a typical spray pattern for a dual nozzle container coating system.

Although rotation of the container at a speed sufficient to create a vortex aids in achieving good weight (or thickness) distribution of the resin, it creates problems in achieving a good coating on the bottom of containers having a domed bottom, which exist on substantially all thin walled, lightweight aluminum beverage containers. A container with a domed bottom is illustrated in FIG. 3. Rapid rotation of a container with a domed bottom tends to throw the coating off the dome. A certain minimum particle velocity is required to cause sufficient particles to reach the outer perimeter of the central dome area.

Non-rotating Containers

According to certain embodiments of the invention, expedients other than can rotation are relied upon to distribute the particulate resin over the interior surface of the container. For example, a tribo-electric charge may be impressed by any of the methods known in the art on the resin so that the individual particles repel each other. The container is maintained at a potential which accepts (or attracts) the thus-charged resin particles.

When the resin particles are distributed across the interior surface of the container by the action of tribo-electric charges, these charges may be relied upon for adherence of the resin to the surface until the curing step. In other embodiments, the container walls are heated to above the resin's softening point to promote adherence of the resin to the surface. In some instances, the container walls are preheated to above the melting point of the resin to promote film adherence and to initiate curing of the film.

Pulse Spraying

A preferred technique for coating slender, cylindrical containers with ultra-thin, high quality coatings is by pulsing predetermined quanta of resin intermittently into the containers. A container is preheated and moved through an application zone wherein a single pulse or multiple pulses of a resin/gas mixture are introduced into the container from a location near but outside the open mouth of the container. Each container may be indexed within the zone so that its central axis is stationary during the period that the gas/resin mixture is being applied. The containers may be rotated during the application stage or other expedients may be employed to distribute the resin across the surfaces to be coated as previously described herein. It is also possible to apply resin to the container interiors as the containers move through the application zone without indexing.

Figure 2:
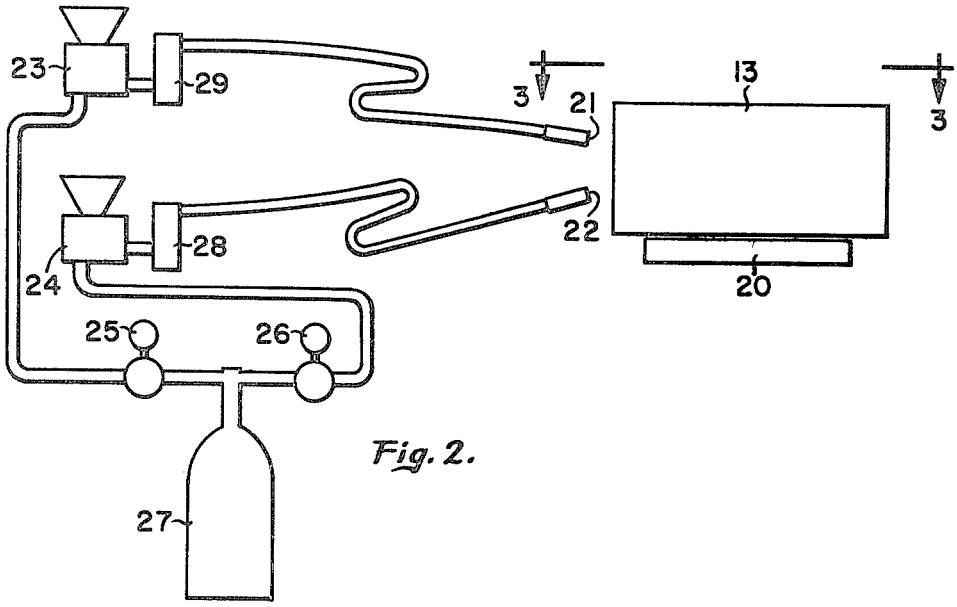
FIG. 2 schematically illustrates a pulse coating system utilizing two spray nozzles.

One technique of pulsing resin particles into a preheated, rapidly rotating container is illustrated by FIGS. 2 and 3. In FIG. 2 a slender, cylindrical container 13, generally one which has a diameter less than about three inches and a length to diameter ratio of about 2:1, is shown resting on a cradle 20 which can spin the container about its longitudinal axis at rates of from 500 rpm to 2500 rpm or higher. A pair of spray nozzles, nozzle No. 1, 21, and Nozzle No. 2, 22, are positioned in close proximity to the open end of the container, e.g., the nozzles are usually within 0.03 to 0.5 inches from the plane which contains the rim of the container opening.

The nozzles are connected by thin tubing to a pair of pulsing devices, 23 and 24, which are connected through a pair of pressure control valves 25 and 26 to a source of high pressure gas 27. The spray system is illustrated in its preferred form, i.e., a pair of spray nozzles are used. Acceptable coatings are obtainable through use of a single nozzle, but coatings having a more uniform distribution over the whole container have been obtained through use of two or more nozzles. Also, a lower film weight film with good characteristics is obtained through use of multiple nozzles.

The gas/resin mixture exiting from the spray nozzles must possess a certain minimum velocity in order to travel sufficiently far into the container to coat the whole of the container, or at least that portion of the container which a single nozzle in a multi-nozzle arrangement is expected to coat. In applying thin coatings, as distinguished from ultra-thin coatings, resin or carrier gas velocities of at least 200 feet per minute can be utilized, for example, to form films of about 0.5 mil or greater which are acceptable coatings. In order to achieve ultra-thin coatings with good resin distribution, a minimum velocity of about 500 feet per minute is required and a velocity in excess of about 5,000 feet per minute is preferred. The velocity referred to is the average velocity of the particles immediately after leaving the spray nozzle for the first few inches of travel.

This "average velocity" is difficult to determine with precision, but for purposes of this disclosure is regarded as the velocity of the front wave of the powder exiting a nozzle, as determined by high speed photographic techniques. It is recognized that the true speeds of individual particles may be considerably greater or less than the average velocities referred to herein. Moreover, it is recognized that the velocities of the particles reduce very quickly as they travel away from the nozzle. Nevertheless, the average velocity, as thus measured, constitutes a useful parameter for process control.

Although the precise phenomena involved may not be perfectly understood, it is known that a barrier of static air persists adjacent the interior surface of the container. It is also known that the resin/gas mixture is deflected by the interior surface (or more accurately, by this "static barrier") so that the resin particles tend to be carried out of the container without impacting against the interior surface of the container unless their individual momentums are sufficient to carry them through the barrier. Increasing the average velocity of the particles is believed to increase the probability of particle penetration of the barrier in two ways. First, the individual momentum of each particle is, on the average, increased. Second, the increased gas velocity associated with the increased average velocity of the particles tends to cause increased turbulence within the container, thereby imparting random directional components to the velocity vectors of individual particles. These factors are especially significant in the case of smaller and/or lighter particles. The minimum acceptable average particle velocity in any given instance will be influenced by such factors as the thickness of the static air barrier; the density, average particles size, particle size distribution and other properties of the resin used; and the location of the spray nozzle with respect to the can to be coated.

Figure 4:
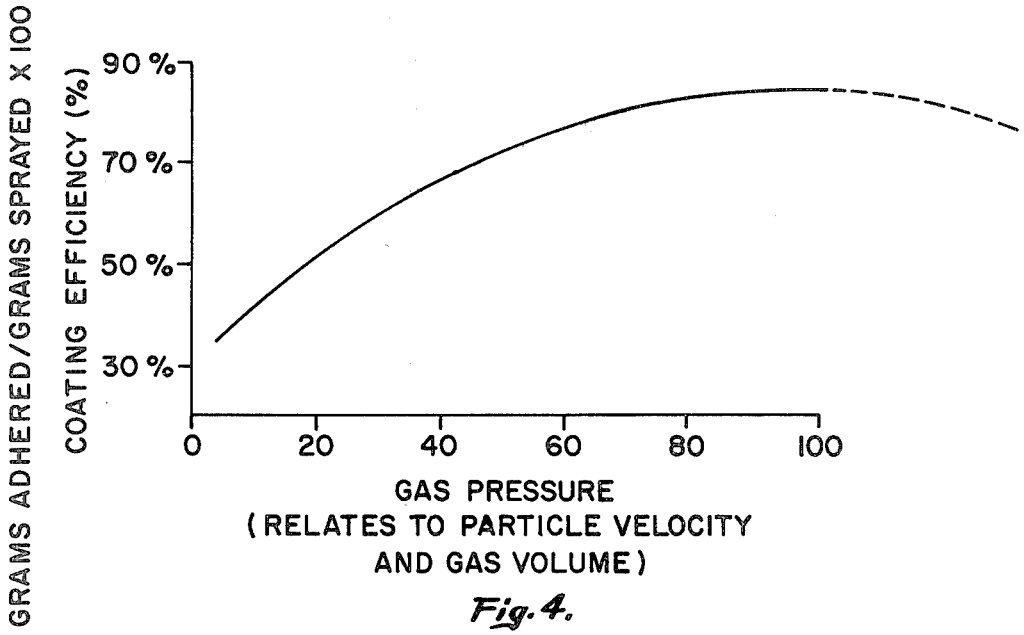
FIG. 4 graphically represents the relationship between coating efficiency and the pressure of a pulse of a gas/resin mixture.

The effect of particle velocity and gas volume upon coating effectiveness has been determined from spraying containers rotated at about 1800 rpm through the use of the system of FIG. 2 wherein the carrier gas was under various pressures when released to the pulsator. FIG. 4 illustrates the effect of increasing particle velocity and increasing carrier gas volume. Coating effectiveness is defined as the percentage of coating deposited upon the container interior as a function of the amount of resin introduced into the container. The difference between the Coating Effectiveness percentage and 100% is the percent of "overspray", i.e., resin which did not adhere to the container interior.

As illustrated in FIG. 4, the coating effectiveness increased from a value of about 30 percent at 10 psi gauge to about 90% at about 100 psi gauge. The volume of gas and velocity of particles at 100 psi gauge is about ten fold the volume and velocity at 10 psi gauge.

The system utilized to obtain the date for FIG. 4 was similar to that illustrated in FIG. 2 wherein a certain static air pressure was applied to the system, which had a constant volume. Upon release of a pulse of resin, the air pressure propelled the resin through the tubing and spray nozzles. Since the volume of the system was constant, the velocity was proportional to the square root of the pressure. Thus, increasing the pressure by a factor of four approximately doubled the velocity. Although exact upper limits have not been determined, gas/resin velocities of about 2000 to about 12,000 feet per minute produce excellent results. It is believed that much higher velocities, e.g., supersonic velocities, are practical and will enhance penetration of the static air barrier adjacent the inner surface of the container by smaller resin particles.

Spray Interval

A uniform quantity of resin is discharged in each instance in FIG. 4 since the volume or weight of resin is predetermined. Also, the total pulse duration of the carrier gas is constant regardless of the gas pressure. The duration for spraying of resin particles may be very short (about 10 to about 50 milliseconds). As compared to conventional liquid application systems (about 75 to 150 milliseconds or more). This very short spray interval makes it possible to introduce pulses of resin into containers as they move continuously through the application zone. For example, a resin pulse of 20 milliseconds duration may be applied while the container travels about 1/6 of an inch. It has been found that results comparable to spraying stationary containers may be obtained in this fashion. The cans may be rotated or other expedients for distributing the resin may be employed. The total gas pulse may be longer, e.g., from about 10% to about 100%, than the period when a substantial resin/gas mixture is exiting from the spray nozzles.

The quantity of resin which exits from a single nozzle during a single pulse can be regulated from about 25 milligrams to about 1000 milligrams. A typical slender cylinder beverage container capable of holding 12 fluid ounces has an interior area of about 43 square inches. Thus, to coat the container with a 0.5 mil film (approx. 10 mgs/square inch), a total of about 430 milligrams is required. Unless the coating effectiveness is 100%, more than 430 milligrams of resin has to be sprayed into the container to achieve a total film weight of 430 milligrams. A single nozzle spray can achieve acceptable films at average thicknesses of about 0.5 mil (approximately 10 mgs/square inch) or greater. At these average film thicknesses, the coating has properties acceptable for a beverage container.

Nozzle Arrangements

The preferred technique for coating container interiors with ultra-thin films has involved a multiple spray nozzle arrangement. As illustrated in FIGS. 2 and 3, a pair of nozzles 21 and 22 are directed into the container. Neither nozzle should be aligned on the central longitudinal axis of the container. If any nozzle lies on the central longitudinal axis, it should be aligned at at least a slight angle to said axis, unless a single nozzle is used in the spraying operation, in which case it is preferred to direct the nozzle discharge along this axis. A preferred arrangement is to have no nozzle on the central longitudinal axis of the container and to have all nozzles disposed at an angle to said axis. A particularly effective arrangement has been to mount a pair of nozzles to discharge at about 90 degrees with respect to each other and with each discharging at about 45 degrees with respect to the central axis of the container. The nozzle discharges mutually impinge, creating a cloud of resin dispersed in the carrier gas. By adjusting the velocities of the nozzle discharges and the spacing of the nozzles from the open end of the container, the cloud may be collimated around the central axis of the container thereby increasing the efficiency of the application. When using a pair of nozzles, approximately one-half of the resin particles to be introduced into the container is usually ejected from each nozzle. The ratio may be varied, however, with the ratio varying from about 10:1 to 1:1, depending upon the function to be performed by a particular nozzle.

Utilizing the system illustrated in FIGS. 2 and 3, containers with ultra-thin coatings thereon, e.g., 0.2 mil and less, have been sprayed. Achievement of films of this weight is dramatic inasmuch as powder coatings had been previously utilized generally only for the purpose of obtaining thicker films and that the attainment of thin films on container interiors had not been achievable by powder coating techniques. Heretofore, thin films, i.e., films less than about 0.3 mil, had not been attainable directly from a coating material, i.e., a 100% solids system. In a solvent system, the achievement of a 0.3 mil film resulted only from the application of a resin-solvent film perhaps 0.6 to 1.0 mil in thickness, which, upon evaporation of the solvent, left a resin film of about 0.3 mil. Electrostatically applied coatings have not been practicable for container interiors because of the Faraday Cage effect, but even application of electrostatically charged particles to a substrate does not result in such ultra-thin films, even after postheating, and the attainment of a very adherent, substantially instantaneous continuous film, as compared to a continuous layer of discrete particles, has never been achievable with an electrostatic spray system.

Continuous Spraying

A container, particularly a slender, cylindrical container, may be coated with a thin, uniform, comestible, organic coating by pneumatically conveying finely divided resinous particles from a powder feeding device to a spraying device at a substantially constant rate which may be varied from about 1 gram per minute to about 150 grams per minute.

A discrete quantum of resinous powder is sprayed into the interior of a preheated container at a velocity sufficient to create substantial turbulence within the container. The particles may be a liquid resin, although more typically are finely divided solid particles having a softening point lower than the temperature of the preheated container. The solid particles become high viscosity liquid upon contact with a container preheated to a temperature in the lower region of the preheat temperatures and adhere to it. The container can then be heated to cause the coating adhered thereto to form a continuous, uniform film of resin on the container interior. At elevated preheat temperatures, the resin particles become a high viscosity liquid upon contact with the substrate. It is feasible to greatly reduce and even eliminate postheating by preheating the container to high temperatures; e.g., about 400° F. and higher.

The resinous material may be continuously fed through the spraying device or it may be fed in pulses of discrete quanta. The resin is caused to adhere to the container by preheating the container to a temperature above the point where the resin becomes liquid. The container is preferably revolved about its longitudinal, central axis, preferably for at least two revolutions per resin pulse.

The device illustrated in FIG. 1 is an apparatus for continuously coating containers through use of a continuous supply of powdered resin. Powder feeder 10 is of the type described in copending application Ser. No. 223,969, filed Feb. 7, 1972, now U.S. Pat. No. 3,987,937, which supplies a substantially uniform rate of resin feed at a rate which may be varied from about 1 gram per minute to about 150 grams per minute. Typical resin feed rates are from about 5 grams per minute to about 100 grams per minute. Regardless of the feed rate selected, it is particularly important that the resin feed rate be substantially uniform inasmuch as each container to be coated will be exposed to the resin spray for the same period of time which, therefore, requires a uniform rate of feed if each container is to receive substantially the same quantity of resin. It is necessary that the containers receive the same quantity of resin inasmuch as the films to be deposited are very thin and any substantial variation of the resin feed rate will result in one container having a thick film and another container having a film which is too thin to perform its function. Film coatings with thicknesses of less than 1 mil and preferably less than about 0.5 mil and as low as about 0.2 to 0.05 mil are preferred thicknesses for container coatings. Since thicknesses less than 1 mil are difficult to measure, the film thickness is often expressed in weight terms, e.g., milligrams per square inch. A film one mil thick has an approximate weight of about 20 milligrams per square inch. Thus, a film weighing 4 milligrams per square inch has a thickness of approximately 0.2 mil.

Typical container coating rates are from about 60 containers per minute to about 600 containers per minute with a typical commercial rate being about 250 to about 350 containers per minute. Thus, at a coating thickness of 0.5 mil for a container having about 43 square inches of interior surface, a total of about 430 milligrams of resin is required. A coating rate of about 60 such containers per minute requires a resin feed rate of 25,800 milligrams per minute or about 26 grams per minute.

The thin coatings must be continuous and possess sufficient film integrity to protect the container from its ingredients and vice versa. The integrity of the film is determined by testing the electrical conductivity of the film. An arbitrary standard has been developed which requires a film to possess a film conductivity no greater than 75 milliamps.

Electrical conductivity is, of course, affected by the thickness of the film. For example, a film having a uniform thickness of 0.2 mil may possess an electrical conductivity of 40 milliamps, while a film having the same average thickness but possessing peaks and valleys wherein the valleys comprise 50 percent or more of the film area and have a thickness of perhaps only 0.05 mil, or even possessing pores wherein no coating covers certain portions of the substrate, may possess an electrical conductivity of 80 milliamps or more. Since a coating with a uniform thickness throughout the whole coating is difficult to achieve, it is especially important to place a minimum thickness of coating on each portion of the container. For example, if it is determined that a certain coating composition applied by certain technique provides an acceptable electroconductivity at a film thickness of 0.2 mil, it is necessary that each container be coated wherein only a small percentage of the surface area has a film thickness less than 0.2 mil.

The powder feeder 10 feeds fine particles of a thermoplastic or thermoset resin having a particle size range of about one micron to about 100 microns. A preferred average particle diameter is about 10 microns or smaller. The particles are delivered to a tube 11 which preferably has a diameter of about 0.1 to about 0.5 inches. The powder feeder discharges resin into the tube at a predetermined feed rate which is substantially uniform although there may exist a deviation of about 10 percent at any given moment. Inert gas is introduced into the powder feeder at a rate of about 1 cubic foot per hour to about 50 cubic feet per hour to convey powder through tube 11 at a velocity sufficient to eject the powder/gas mixture from a nozzle at a velocity of above about 200 feet per minute, preferably above about 2000 feet per minute. It is generally preferred that the discharge velocity of the resin/gas mixture from the spray nozzle 12 be sufficient to cause substantial turbulence in the container. The preferred higher resin velocities, i.e., 2000 to 12,000 or more feet per minute, are more easily achieved by pulse spraying techniques.

The spray nozzle 12 preferably has a diameter no larger than the interior diameter of tube 11 and in many instances the outlet diameter of the nozzle is substantially smaller than the tube diameter so that the velocity of the resin through the nozzle is increased. Nozzle outlet diameters are frequently in the range of about 1/10 to about 4/10 and preferably about $\frac{1}{8}$ to about $\frac{1}{4}$ inches. Nozzle 12 is preferably closely adjacent to the open mouth of a container, said container having one closed end, which may be a simulated closed end, and one open end.

It is generally preferred that the resin be conveyed with a minimum amount of gas so that the least cooling effect possible is experienced by the preheated container. This is especially necessary when the temperature of the preheated container is only 225° F. to about 250° F.

Container 13 is introduced to a position directly in front of nozzle 12 at a rate of about one per second to about ten per second. A continuous supply of resin at a predetermined rate is discharged from nozzle 12 into container 13 for a predetermined period of time, which is usually less than the residence time of container 13 in a spraying position. For example, containers being introduced to position before nozzle 12 at a rate of about one per second may be sprayed with resin for a period as short as 0.5 second or even 0.03 second or less. The spray period is determined by the reciprocating mechanism 14 comprising a pneumatic or hydraulic cylinder 15 and arms 16 and 17 which, in an up position, places nozzle 12 directly adjacent the open end of container 13 and which, in a down position (illustrated by the dotted lines), places nozzle 12 directly at the mouth of a receiver 18 in which there is a slight negative pressure due to a blower 19 which conveys the collected resin to a recycle receptacle or directly back to powder feeder 10. The recycle collection apparatus permits the continuous, uninterrupted feeding of resin to nozzle 12 and the intermittent spraying of containers.

It is generally preferred to revolve the container about its central, longitudinal axis for about two revolutions during the time it is being sprayed. Because of the time available for spraying, it is generally required that the container rotate from about 500 to about 5000 revolutions per minute with speeds of about 1000 to about 2500 revolutions per minute being typical.

Figure 7:
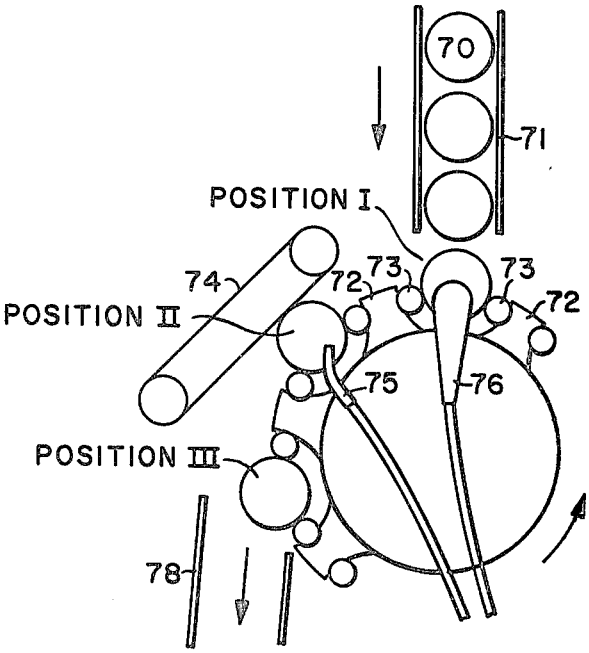
FIG. 7 is an elevational view of a commercial container coating apparatus having a preheat station and a spraying station.

A preferred embodiment for practicing the instant invention is illustrated in FIG. 7. As heretofore mentioned, a commercial can coating operation costs at an optimum rate of 250 to 300 cans per minute, although a can line may be operated as slow as 180 cans per minute. The significant of these rates becomes apparent upon examination of the preferred embodiment.

In FIG. 7, cylindrical containers (cans), which in the preferred instance are two-piece containers, i.e., cans having one closed end, are dropped through an elevator 71 into a cradle formed by a pair of lugs 72 having rollers 73 thereon. The lugs 72 are attached to or are part of a starwheel which rotates about a central axis to transport the containers from the feed elevator 71 to the discharge elevator 74. The containers proceed counterclockwise in the apparatus illustrated in FIG. 7 from a preheating station (Position I) to a spray station (Position II) to a discharge station (Position III).

As is apparent from the structure of the starwheel, a container resides in Position I and II for exactly the same length of time. Thus, the number of containers which can be coated per minute is limited by the time required at any single position. Because of this, several characteristics of the instant process become important, such as the short period of time required for either preheating or spraying and the ability of the preheating step and the spraying step to be substantially synchronized; i.e., no single step of the process requires substantially more than any other step.

In Position II the container is rotated at a speed of at least about 500 rpm by means of belt 74 and wheel 75. The container begins to rotate in Position I, although it may not reach maximum rotational velocity until it reaches Position II. Preferably, the container is rotated at the same rotational velocity during preheating as during spraying inasmuch as the turbulence created by rotation facilitates heat transfer. A slender, cylindrical container 70 drops from feed elevator 71 to a preheating station (Position I) where the container is heated by a plasma arc device 76 for a short period, e.g., from about 200 to 300 milliseconds, to a temperature in excess of 225° F., and preferably in excess of 300° F.

The container is then quickly advanced from Position I to Position II by counterclockwise rotation of the starwheel. Finely divided resin particles are uniformly sprayed into the container from a spray nozzle 77 by a carrier gas. At a rotational speed of 500 rpm the container rotates about three rpm during a period of 300 milliseconds. The rotational velocity of the container can be regulated between about 500 and 1800 rpm on commercially available starwheels. A minimum of two revolutions of the container is preferred during the period resin is being sprayed into the container. The resin particles, preferably of a size less than 100 microns, adhere to the container interior in a uniformly distributed manner. The container remains in Position II the same length of time as in Position I.

From Position II the container advances to Position III, where the container discharges into discharge elevator 18. At Position III the coating on the container interior is not fully matured if the preheat temperature has been in the lower range, i.e., about 225° F. to about 300° F., which means that it is not:

(1) a fully cured film, if a thermosetting resin was used, or (2) a fully developed coating, if a thermoplastic resin was used.

For either thermoset or thermoplastic resins, the film produced must be ultimately fully continuous, impermeable, and preferably of a substantially uniform thickness not exceeding about 0.5 mil. Upon initial contact of the resin particles with the preheated substrate heated at about 225° F. to about 300° F., a continuous film which is of uneven thickness is formed. The temperature of the container is above the softening point of the resin particles but not above the melting point. (The term "melting point" is more applicable to the low molecular weight thermosettable resins than to the high molecular weight thermoplastic resins for which a comparable temperature is the "flow point".) The resin particles at the lower preheat temperature are sufficiently softened that a substantially continuous film, which is of uneven thickness, is formed. The coating formed at the lower temperatures, e.g., 225° F. to 250° F., will generally pass the copper sulfate test but will not pass the boiling water or Enamel-Rater tests without further processing. A coating formed at low temperatures can be rendered fully matured by postheating at elevated temperatures for a brief period, e.g., 300 milliseconds before a plasma arc device, to elevate the temperature to 425° F. to 500° F. or by immediately transferring to an oven to be heated at 450° F. for a few minutes.

Preheating the container to temperatures of above about 250° F. enables the formation of a continuous film which is substantially uniform in thickness, provided the spray technique is capable of applying such films. Thus, such a film, if the resin is a thermosettable one, requires only a very brief postheating at elevated temperatures to affect curing of the film.

Preheating the container to temperatures in excess of about 350° F. and preferably above about 425° F. permits application of films which are continuous and will fully mature without addition of energy if the thermal energy of the container is conserved. The storage of enough thermal energy in the container to mature fully the coating applied thereto is a unique feature of the instant invention. In the instant process this is achievable even though the preheating and spraying operations are conducted in an environment at ambient temperatures because of the rapid heating to the desired temperature, the rapid transfer of the container from the preheat station to the spray station, the rapid spraying of the container while avoiding conditions, e.g., excess carrier gas, which tend to cool the container, and rapid transfer of the container to a heat conservation zone.

Figure 9:
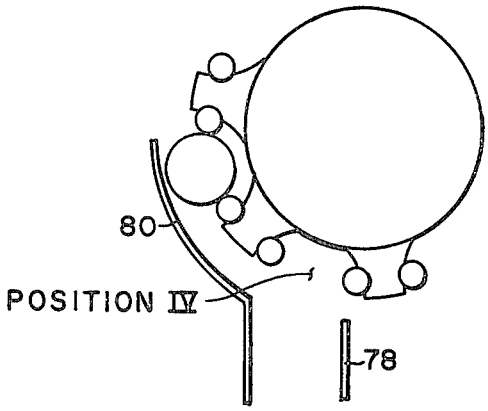
FIG. 9 is a partial elevational view illustrating a modification to the apparatus of FIG. 7 to provide a post-heating station.

As illustrated in FIG. 9, a curved retainer band 80 may be positioned alongside the starwheel adjacent Position III to retain the container at Position III for the same period it experienced in Positions I and II. The container is then discharged at Position IV into discharge elevator 78 which has been displaced to a position underneath Position IV. This modification of the starwheel assembly permits postheating of the container in Position III for a period sufficient at a predetermined temperature to cause the coating to mature. A plasma arc device of the type used to preheat is preferred to accomplish the postheating because of its rapid heating effect. The degree of postheating required depends upon preheat temperatures and resin characteristics.

When preheating is below 300° F., or even below about 350° F., postheating may be delayed for prolonged periods without adversely affecting the coatings upon eventual cure. When preheating temperatures of 300° F. or above are used in conjunction with typical thermosetting resins, it becomes important to raise the temperature of the resin to its curing point, usually 400° F. or more, substantially immediately, ideally within about 3 seconds, following the spray interval. This procedure is especially important when the metal surface temperature of the container at the commencement of the spray interval is about 350° F. or higher.

A typical thermoset resin, for example, one having a softening point of about 120° F. to about 150° F., a "melting point" of about 300° F. to about 350° F. and a curing temperature of about 350° F. to about 400° F., requires postheating when the container is preheated to a temperature of only 150° F. to about 250° F., and even as high as 300° F. because some cooling occurs between Positions I and III so that the temperature of the resin never reaches its curing point (or flow point for a thermoplastic resin). However, with such resins it has been determined that preheating the container to temperatures greater than 425° F., and preferably above 450° F., but not in excess of 525° F. for aluminum containers, is sufficient input of thermal energy to cause the resin particles to adhere, to flow immediately into a continuous, pore-free film of substantially uniform thickness and to cure if thermal energy losses, e.g., convection and radiation losses, are substantially minimized. Thermal energy loss can be prevented by supplying thermal energy as fast as it is lost, e.g., a mild postheat, or by conveying the container immediately after spraying to an insulated conveyor whereby heat losses are minimized.

In FIG. 7, a container preheated to a temperature of 425° F. or greater in Position I is conveyed to Position II for spraying and is then discharged at Position III into the discharge elevator. Insulating elevator 78 and a portion of the conveyor system following thereafter for a distance sufficient to maintain the container temperature above 350° for a period of about one to two minutes. At a container rate of 250 containers per minute and a container diameter of two inches, a single line conveyor insulated for a distance of about 40 feet enables the containers to be conveyed in an insulated environment for about one minute.

A significant energy savings is realized through conservation of the preheat energy to mature fully the resin film. Although the mass of metal containers, particularly aluminum containers is small in relation to area, the preheating step with a plasma arc generated flame has been found effective to produce a container with a fully matured film on the container interior without requiring additional heat. A further signficant advantage of the instant invention is that the preheating step, spraying step and postheating step, if desired or required, can be accomplished in such a very confined space in such a short time that substantially no thermal energy imparted to the container is lost to the environment.

Figure 8:
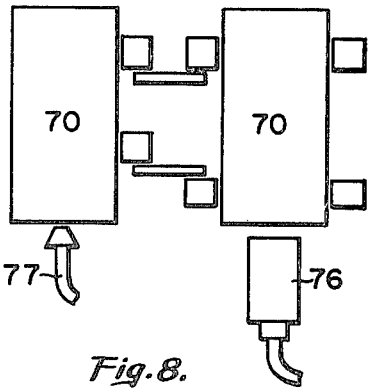
FIG. 8 is a plan view of the apparatus of FIG. 7 illustrating the juxtaposition of containers in the preheat and spraying stations.

Although advantages exist for preheating or postheating containers with a plasma arc device such as illustrated in FIGS. 7 through 9, it is to be understood that other heating techniques are effective for preheating and/or postheating containers within the practice of the instant invention. Hot air ovens, infrared heaters and the like may be employed to heat containers. In using other sources of thermal energy, care is to be exercised to provide a heated container having a substantially uniform temperature. Any heating device which heats one portion of the container above its metallurgical limit and fails to heat another portion of the container above the minimum temperature desired is to be avoided.

EXAMPLE I

Cylindrical containers having one open end and one closed end were coated with a thermoset epoxy coating. Fine particles of an epoxy resin, Epon 1004, including an appropriate quantity of dicyanodiamide (approximately 6%), having an average particle size of about 20 microns were introduced into a powder feeder having the capability of feeding powder at the rate of about one gram per minute to about 150 grams per minute at a substantially constant rate.

Fine resin particles were conveyed at a substantially uniform rate of about 0.2 grams per minute by an inert gas at a rate of about 20 cubic feet per hour. The resin was conveyed through a $\frac{1}{8}$ inch plastic tube. Resin was introduced from the tube into cylindrical containers which had been preheated to between 150° F. and 200° F. Both stationary and rotated containers were coated. The resin was sufficiently melted by contact with the container interior to adhere thereto. The containers were rotated at a speed of about 200 rpm. The rotated containers had a more uniform dispersion of resin adhered to the interior surface.

The resinous coating was not continuous as applied although an average resin distribution of about 10 milligrams per square inch was achieved.

A cured, continuous coating was obtained by postheating the container at a temperature of about 425° F. for about 2 minutes. The rotated containers had a more uniform film thickness.

The resin was fed continuously by the powder feeder. The powder was directed into a single container for about 0.2 seconds.

EXAMPLE II

Cylindrical containers having one open end and one closed end were coated with a thermoset epoxy resin, Epon 1004 with a 6% dicyanodiamide catalyst.

Fine particles having a maximum particle size of less than about 100 microns and an average particle size of about 20 microns were fed from a powder feeder device to a pulsing device having the capability of feeding predetermined pulses of resin in quantities from about 0.2 grams per minute to about 5.0 grams per minute over a pulse period of from about 1/20 second to about 1 second.

A container having an internal area of about 35 square inches was heated to about 200° F. A resin pulse of about 0.4 grams was sprayed into the container in an inert gas stream at a velocity of about 1000 to 3000 feet per minute for a period of a few hundred milliseconds.

A continuous coating of resin particles adhered to the interior surface of the container.

A second container rotated at about 200 rpm was coated in a similar manner. A continuous coating of resin particles adhered to the interior surface of the container.

Both containers were postheated at 425° F. for a period of about 2 minutes. A cured, thermoset film resulted in each instance. The container which had been rotated had a significantly more uniform coating.

Both containers were subject to an Enamel-Rater test. The coatings exhibited conductivities as follows:

Stationary Container—75 ma
Rotated Container—12 ma

EXAMPLE III

A slender, cylindrical beer container having one end thereon was coated with a thin, resinous coating. The container, approximately $5\frac{1}{4}$ inches in length by about $2\frac{1}{2}$ inches in diameter, had an interior area of about 43 square inches.

The container was placed in an apparatus similar to FIG. 2 wherein Nozzle No. 1 was located about one inch from the mouth of the container and at an angle of about 10° from the longitudinal axis of the container. The spray from Nozzle No. 1 was directed at a portion of the container side wall. Nozzle No. 2 was located about one-half inch from the mouth of the container and an angle of 3° from the longitudinal axis of the container. The spray from Nozzle No. 2 was directed to contact the moat and about one-half the domed area of the bottom of the container opposite the spray nozzle.

Each nozzle was connected to a resin pulsing device of the type described in copending application Ser. No. 492,498 now U.S. Pat. No. 3913795 wherein a resin/gas mixture could be provided from the pulsator to each nozzle for a predetermined duration of about 50 milliseconds to about 300 milliseconds. A constant amount of resin may be provided by the pulsator regardless of the duration of the spray period. A chamber of different volume can be placed in the pulsator to change the quantity of resin provided during a spray period.

The volume and velocity of gas carrying the resin may be increased or decreased by increasing or decreasing the pressure of the gas provided to the pulsator.

Powdered resin was placed in each hopper of a pulsator. The powder was a thermosettable epoxy resin, Epon 1004, with 6% dicyanodiamide catalyst, having a particle size range from about 10 microns to about 100 microns with an average particle size of about 30 microns.

A two-piece aluminum beer container (Container No. 1), having an interior area of about 43 square inches, was heated to about 150° F. The container was placed in front of spray nozzles Nos. 1 and 2 as illustrated in FIG. 1. The container was not rotated. The carrier gas pressure was set at 90 psi guage. Two 30 millisecond bursts of gas and resin were directed into the container. The resin was sprayed first from Nozzle No. 1 and about 30 milliseconds later, resin was sprayed from Nozzle No. 2. A total of about 700 milligrams of resin was sprayed, of which only about 350 milligrams adhered to the container interior. Large areas of the container were bare even after heating the container at 425° F. for a period sufficient to cause film continuity on certain parts of the container. The coating was unacceptable for any purpose.

A second two-piece aluminum beer container (Container No. 1') was treated the same as Container No. 1 except that the nozzels were positioned so that their discharges intersected at the opening of the can at its center. The resin entered the can dispersed in a cloud. After curing in an oven for two minutes at 400° F., the can was filled with a standard copper sulfate/HCI test solution for 5 minutes. No copper was deposited, indicating a continuous film.

A two-piece aluminum beer container (Container No. 2) having an interior area of about 43 square inches was heated to about 150° F. The container was sprayed in the same manner as Container No. 1 just described except that the container was rotated at a speed of about 500 rpm. A discontinuous coating was formed which became continuous and cured upon postheating at 425° F. for about three minutes. A total film weight of about 400 milligrams was present. The coating exhibited an acceptable film conductivity, less than 75 milliamps, when tested in an Enamel-Rater.

A third container (Container No. 3) was sprayed in the same manner as Container No. 2 except that the container was rotated at about 1800 rpm after having been preheated to 425° F. A continuous film having a total weight of about 400 milligrams of very uniform distribution was immediately formed upon contact of the resin particles with the container. The coating was at least partially cured and upon postheating at 425° F. for sixty seconds, the coating was fully cured and exhibited a film conductivity of only three milliamps when tested in an Enamel-Rater.

A fourth container (Container No. 4) was sprayed in the same manner as Container No. 3 except that the container was preheated to about 500° F. A continuous film having a total weight of about 400 milligrams of very uniform distribution was immediately formed upon contact of the resin particles with the container. The container was at least partially cured and upon being insulated in an insulated box having a temperature of about 400° F., the coating was fully cured and exhibited a film conductivity of only three milliamps when tested in an Enamel-Rater.

In the description of the instant invention, both film weights per unit area and film thickness have been referred to. The following table provides an equivalency guide between these means of identifying film thickness and provides an equivalent weight for a 12 ounce beer container having an internal surface area of 43 square inches.

EXAMPLE IV

A two-piece aluminum beer can is preheated to a temperature of 210° F. in an electric oven. The preheated can is located on a continuously revolving wheel near the perimeter of the wheel. As the wheel revolves around its axis, the beer can is carried through an application zone including two spray stations. Each spray station includes a pair of nozzles mounted to discharge at about 90 degrees with respect to each other and about 45 degrees with respect to the central axis of the can as the can passed beneath the nozzles. The nozzle orifices are located such that the center of the top of the can passes directly across their centers. The can travels at about two feet per second through the application zone so that it intersects each pair of nozzles approximately 225 milliseconds. The first spray station discharges a pulse of approximately 200 milligrams of resin dispersed in approximately 200 cc of air over a spray interval of about 30 milliseconds. The pulse is timed to discharge when the central axis of the can is about 1/12 inch short of locating directly between the two nozzles. The discharge is thus completed by the time that the can axis is located an approximately equivalent distance beyond this reference point. The second spray station applies a similar pulse in the same fashion about ½ second later.

The thus-sprayed container is transferred from the wheel to a curing oven wherein it is exposed to 425° F. for about 1 minute. The resultant container has about 225 milligrams of adherent resinous coating with an enamel rater value of 0 milliamperes (demonstrating a continuous film over the entire interior surface of the can).

The resin leaving the nozzels has a substantial triboelectric charge which was developed as a consequence of being conveyed through a length of plastic tubing prior to the nozzels. The sprayed resin which does not adhere to the can is collected and may be recycled without reconditioning.

| Film Weight in Milligrams | | Film Thickness |
|---|---|---|
| 12 Ounce Container | Per Square Inch | in Mils |
| 860 | 20 | 1 |
| 430 | 10 | 0.5 |
| 215 | 5 | 0.25 |
| 107 | 2.5 | 0.125 |
| 86 | 2.0 | 0.10 |

A particularly preferred technique for coating containers according to the instant invention comprises use of a pair of nozzles, as in FIG. 3, wherein the nozzles are angled toward each other and the longitudinal axis of the container and each located at an angle of about 40 degrees to about 50 degrees from the central longitudinal axis of the container so that the spray pattern from each converge and mutually impinge. The nozzles may be located about one to about two inches apart and preferably from about 1.5 to about 1.7 inches. Preferred distance of the nozzles from container mouth in most instances is from about 0.03 to about 0.5 inches. The spray pattern emanating from each nozzle is preferably a fan or cone shape having an included angle at the nozzle of about 40 to 45 degrees. Ideally, the nozzles are discharged simultaneously. A second pair of nozzles may be used to apply a second pulse of resin into each container as it progresses through the application zone, preferably before the resin first applied is cured.

EXAMPLE V

Figure 10:
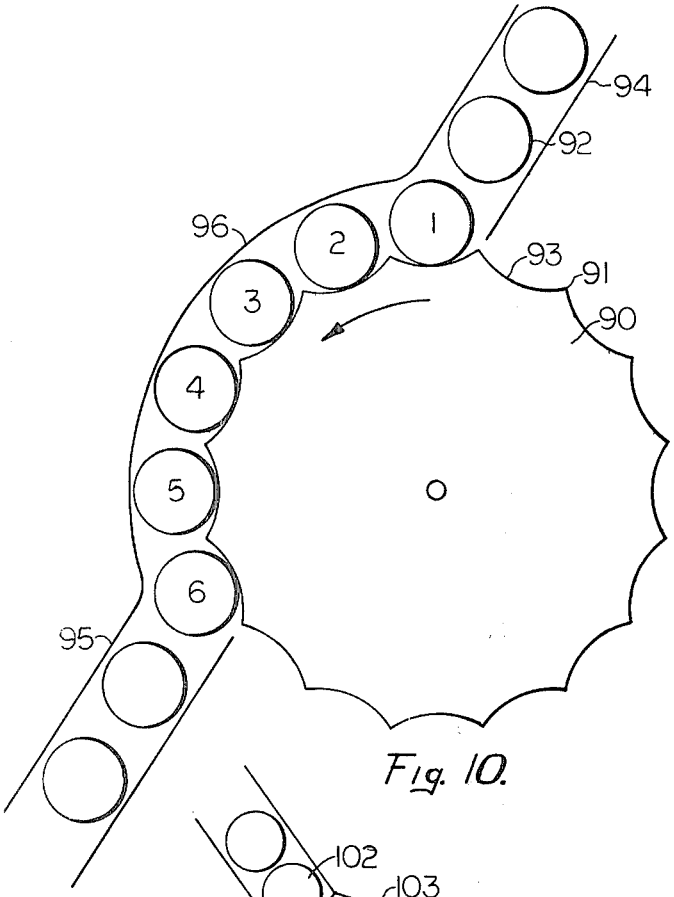
FIG. 10 is an elevational and partially schematic view of an alternative container coating apparatus.

The apparatus of FIG. 10 includes a wheel 90 with its perimeter 91 configurated to receive containers 92 in a plurality of recepticles 93. As the wheel 90 rotates counterclockwise, individual containers 92 are deposited from an entrance chute 94 and are transported by the wheel toward an exit chute 95 through which they are discharged. A wall 96 of the exit chute 95 is configurated as a guide to retain the containers 92 within their respective recepticles 93 during transit. The containers are not rotated by this apparatus, contrary to the apparatus of FIG. 7. As illustrated, there are six container locations indicated by numerals 1 through 6, respectively, associated with the wheel 90 between the entrance chute 94 and the exit chute 95.

The six container locations, 1 through 6, may all be regarded as within a resin application zone. Any or all of the individual locations, 1 through 6, may be adapted as a spray station with one or more nozzles, and each spray station may be programmed to apply a single or multiple pulses of resin.

Using a single spray station, the wheel 90 is set to rotate at a speed providing for a rate of 250 containers per minute transported from chute 94 to chute 95. This rate may be doubled by adding a second spray station, and spraying every other container at each station. In like fashion, the rate may be increased six fold (i.e., 1500 containers per minute) by relying upon six spray stations and assigning each station to every sixth container.

Good commercial coatings are achieved with this procedure by preheating the containers to about 200° F. and arranging the nozzles to direct pulses of resin down the center axis of the container during a spray interval of about 30 milliseconds, all generally as described by Example IV. All of the spray stations in the application zone may be associated with a single rotary pulsator of the type described by U.S. Pat. No. 4,006,846, the disclosure of which is incorporated by reference. Individual metering chambers 146 of the flexible rotor 152 of such a pulsator may be assigned to individual spray stations 1 through 6 as shown. If multiple pulses are desired, additional metering chambers 146 may be assigned this task. Accordingly, the coating rate may be multiplied without increasing the wear on the pulsator.

EXAMPLE VI

The apparatus of FIG. 10 may be set up as in Example V except with the spray stations (e.g., nozzles and resin supply conduits) mounted to travel with the containers. That is, each "spray station" travels at the same rate as the containers so that each container is registered with a nozzle (or nozzles) during at least a major portion the transit interval between the entrance chute 94 and exit chute 95. As a consequence, the spray nozzles may be aligned as desired during the entire spray interval with respect to the container's axis, thereby improving coating distribution. Moreover, the spray interval may be increased substantially, e.g., to 150 milliseconds or longer. An increased spray interval also improves coating distribution. These expedients are especially advantageous for coating two-piece beer or beverage containers.

Conductivity Determination

The film conductivity (Enamel-Rater) test employed in evaluating container coating integrity involves impressing a constant voltage upon an electrolytic cell having as one electrode the container body with a stainless steel electrode immersed in an aqueous electrolyte, preferably a sodium chloride solution, although other salts (such as potassium chloride, sodium carbonate and the like at various concentrations) may be employed. The electrolyte occupies most of the container volume. A typical test is done by impressing 12 volts across the electrodes, using a one percent (1%) by weight sodium chloride solution in water. A suitable enamel rating machine is available from the Waco Company in Chicago, Ill.

The purpose of the film conductivity test is to predict migration of iron or aluminum ions from the container into the contents of the container. It is estimated that a twelve ounce aluminum beer container having a film conductivity of 75 milliamps would experience a migration of about 150 to 200 parts per million of aluminum ions through the coating and into the beer during a storage period of about three months.

A higher film conductivity (lesser film integrity) can be tolerated for beer containers than for soft drink containers because of the greater acidity of soft drinks. For example, a film conductivity of 75 milliamps is generally regarded as acceptable for beer containers while a 10 milliamp conductivity is considered an upper limit for soft drink containers. The tolerable film conductivity or film integrity may vary if the storage time of the container with contents is known to be short; for example, a container whose contents are used within one month after filling may be acceptable even though it has a film conductivity three times as great as a filled container which has a storage life of three months.

EXAMPLE VII

Several two-piece steel containers were sprayed utilizing an apparatus similar to that illustrated by FIG. 7. Two nozzles were mounted as described in Example V in each of two spray stations so that it was possible to apply all of the resin in a single pulse (one station) or divide the resin into two pulses (two stations), the second pulse being delivered about ½ second after the first. The containers were preheated to about 200° F. Coating efficiency in each instance was about 50%, that is, about half of the resin sprayed adhered to the container. After spraying and curing, the containers were tested with a Waco enamel rating machine utilizing a one percent (1%) by weight sodium chloride solution in water and an applied potential of 6½ volts. A reading of 10 milliamperes or less is deemed acceptable for beer and beverage containers under these conditions. Results are reported in the following table.

| Number of Coats | Milligrams of Resin Adhered to the Container | Enamel Rating Readings in Milli-amperes |
|---|---|---|
| 1 | 150 | 30 |
| 1 | 225 | 0 |
| 2 | 150 | 10 |
| 2 | 175 | 0 |

EXAMPLE VIII

Figure 11:
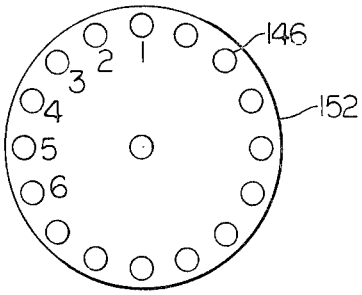
FIG. 11 is a schematic view of an embodiment of the container coating process of this invention including preheat and curing zones.
Figure 11:
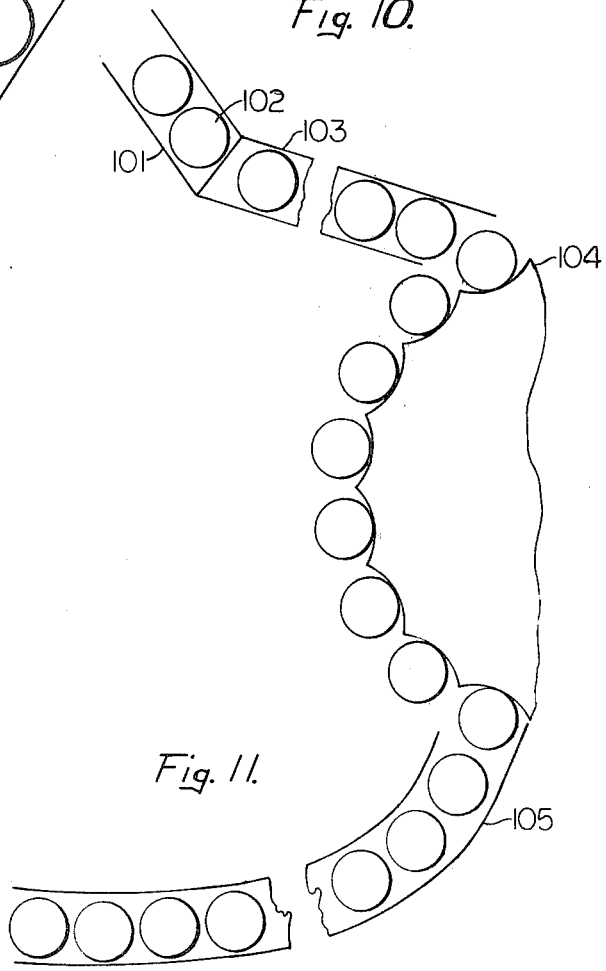

Referring to FIG. 11, a feed chute 101 delivers two-piece aluminum beer cans 102 into a preheating zone 103 on a continuous basis at the rate of 275 cans per minute. The preheat zone 103 comprises an induction oven formed as an elongated duct which maintains an internal temperature of about 225° F. Cans 102 are discharged to a coating zone 104 comprising a wheel of the type illustrated by FIG. 10 at an initial temperature of about 200° F. The cans are sprayed in the fashion described by Example V with the nozzles set so that the resin streams intersect at the mouths of the cans. The resin powder thermally adheres to the entire inside surface of the cans.

The coated containers 102 are discharged from the wheel 104 into a cure zone 105 comprising a second duct adapted as an electric oven operating at about 500° F. The cure zone 105 is about 15 feet long so that the curing dwell time is about 15 seconds. All curing is effected in a single zone, as contrasted to the multi-zone gas ovens required by solvent-coating systems. Coating smoothness is enhanced, particularly with thin coatings (e.g., 0.2 mils), by utilizing curing temperatures substantially above 350° F., e.g., 450° F. or higher.

EXAMPLE IX

Figure 12:
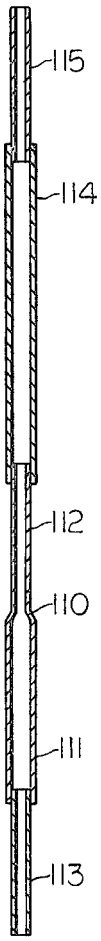
FIGS. 12 and 13 illustrate alternative devices for applying a tribo-electric charge to resin particles as they are transported to the nozzles of a spray station.
Figure 13:
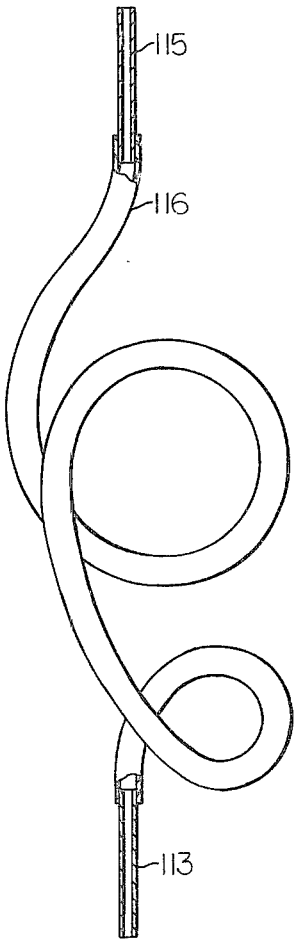

FIGS. 12 and 13 illustrate alternative devices for applying a tribo-electric charge to resin particles as they are transported to the nozzles of a spray station. FIG. 12 illustrates a "tribo-nozzle" 110 inserted in the feed lines between the powder source and spray nozzles. The tribo-nozzle 110 has a larger entrance 111 than exit 112. Resin is introduced to the nozzle 110 through an input line 113 and is discharged into a larger diameter conduit 114. In some instances, this conduit 114 may be of conductive material held at a predetermined e.g., ground, potential. The exit line 115 is similar in diameter and material of construction to the line 113, and is connected to a spray nozzle. FIG. 13 illustrates a looped plastic, e.g., of teflon, tube 116 which may be connected between the input line 113 and exit line 115 rather than the tribo-nozzle of FIG. 12. Tribo-electric charges sufficient for dispersing finely divided resins of the types disclosed in this application may be achieved by forcing the resin through the lines 113, 115 at rates of about 100 to about 300 feet per second.

EXAMPLE X

A two-piece aluminum beer can was preheated to 200° F. After a short period, the metal temperature at the bottom of the container was 190° F. and the metal temperature of the sidewalls near the top of the container was 140° F. The bottom of the container was about 12 mils thick as compared to about 3.5 mils for the sidewalls. The can was coated with a single pulse of resin powder effecting a coating of about 150 milligrams. From visual observation, it was apparent that the bottom of the container was above the melting point of the resin because the coating was clear and transparent. The coating on the sidewalls appeared white, indicating that the resin adhering to the sidewalls had not melted. The coated container was exposed to 400° F. heat for one minute. It was then filled with a copper sulfate solution in hydrochloric acid. No copper was deposited on the can metal, indicating that the resin coating was continuous.

A second container prepared in the same way was tested in accordance with the procedures of Example VII, and had an enamel rating machine reading of 10 milliamperes.

The invention as presently envisioned contemplates coating either a two-piece container (one with an integral closed end) or a three-piece container (one with both ends open). In the second instance, a closure for one end, e.g., a spray plate, is provided to seal one end of the container during the spray interval. The interior surface of the container is then heated (preheat) to a temperature above the softening point of the resin to be used. Useful preheat temperature may be as low as 150° F., but normally exceed 225° F., and preheat temperatures in excess of 300° F. are generally preferred. The container may be rotated during the spray interval, preferably at least two revolutions. A predetermined quantity of resin is pheumatically conveyed into the interior of the container during the spray interval through the open end of the container, preferably through one or more nozzles located outside the container under conditions wherein:

(a) The resin is in powder form and has a maximum particle diameter of less than about 20 microns. Preferably the resin particles are approximately round (or at least rounded) and the average diameter of the particles is less than about 8 microns.

(b) The particle velocity of the resin is sufficient to penetrate through the static air barrier adjacent the interior surface of the container.

(c) The resin is ideally conveyed over a short period, about 10 to about 50 milliseconds.

Following the spray interval, the thus-applied resin is heated (postheating) to cure it into a substantially uniform, solvent-free, ultra-thin coating. Ideally, a tribo-electric charge is applied to the resin particles to aid in their dispersal within the carrier gas. Moreover, it is highly preferred to correlate the resin composition with the preheat temperature so that the individual particles adhere to the surface, melt, flow, gel and partially cure, all within a period of less than about 150 milliseconds. Typical useful thermoset epoxy resins have softening points of between about 120° F. and about 150° F., and useful postheat temperatures for such resin usually exceed 350° F., e.g., 400° F. or more. Of course, other parameters may be preferred when thermoplastic resins are used. The resin is often introduced through a plurality of nozzles and/or in a plurality of pulsed quanta.

The procedures described herein are intended for adaptation to a commercial can line which may include a mechanism for rotating the cans around their longitudinal axes. In other instances, the cans merely travel continuously through an application zone without rotation.

The methods of this invention are useful for producing a broad class of coated metal containers heretofore unknown within the art. The useful substrate (interior surface) may be either light or heavy gauge aluminum, tin plate, conventional container quality steel, or tin-free steel, as well as any other metal useful for producing a container of the type commonly referred to as a "tin can". This substrate is coated with a substantially uniform, continuous, solvent-free, thin layer of resinous material. The resulting containers have broad utility, particularly for the storage of food and beverages.

Although the invention has been described by reference to specific embodiments, it is not intended to be limited solely thereto but to include all the modifications and variations falling within the scope of the appended claims.

We claim:

1. Method for applying an ultra thin resinous coating less than 1 mil in thickness to the entire interior surfaces of a plurality of thin-walled, cylindrical, metal beverage containers having an open end and a closed end, comprising:

heating each container until at least its bottom is above the softening point of a selected resin;

moving the thus heated containers in a sequence through an application zone, and while each container is in said application zone, and said bottom is above the softening point of said resin, introducing at least one pulse of said resin in finely divided solid form with maximum individual particle diameters of less than about 20 microns, said resin being suspended in a carrier gas, approximately axially toward the closed end of said container through the open end of said container from a region outside the container at a velocity sufficient to project particles of resin to the bottom of said container, thereby to cover substantially the entire interior surface of said container with a resinous coating;

causing said resin particles to adhere to the interior surface of the sidewalls of said container by either heating said sidewalls to above the softening point of said resin, imposing tribo-electric charges on said resin particles or both heating said sidewalls to above the softening point of said resin and imposing tribo-electric charges on said resin particles; and moving the containers in sequence from said application zone and curing said coating into an adherent, solventfree, substantially continuous film.

2. A method according to claim 1 wherein said pulse is created by directing the discharges from a pair of nozzles so that they intersect at the open end of the container at approximately its center.

3. A method according to claim 1 wherein each container is moved to the application zone and is indexed therein during the spray interval so that its central axis is fixed with respect to said zone during the interval of said pulse.

4. A method according to claim 1 wherein the containers are moved continuously through said application zone during the interval of said pulse.

5. A method according to claim 4 wherein said pulse is introduced through means which travel with each container so that the central axis of said container is fixed with respect to said means during the interval of said pulse.

6. A method according to claim 1 wherein at least two pulses of resin are so directed in said application zone prior to curing said coating.

7. A method according to claim 6 wherein the containers are comprised of steel.

8. A method according to claim 1 wherein the container is heated so that at the time said pulse is introduced, the interior surface at the bottom of the container is above the softening point of the resin and the interior surface of the sidewall of the container is below the softening point of said resin.

9. A method according to claim 8 wherein said pulse is directed toward the bottom of the container along approximately the center axis of the container so that a portion of the resin particles adhere to the bottom and the remainder of the resin particles are forced out towards the side walls and then along said side walls towards the open top of the container.

10. A method according to claim 9 wherein a first said pulse is followed by a second said pulse before said coating is cured.

11. A method according to claim 8 wherein said pulse is created by directing the approximately simultaneous discharges from a pair of nozzles into each other at a region outside the container and at approximately the center axis of said container.

12. A method according to claim 1 wherein said resin is dispersed in said carrier gas by means of sufficient tribo-electric charges imposed on said resin particles to cause said particles to adhere to the sidewalls of said container.

13. A method according to claim 1 wherein said container is an aluminum cylinder with one end closed and with side walls less than about 4 mils thick.

14. A method according to claim 1 wherein means for curing said resin after it is applied to said containers is provided in association with said application zone so that containers are introduced directly from said application through said curing zone.

15. A method according to claim 14 wherein said means for curing comprises electric oven means.

16. A method according to claim 14 further including means associated with said application zone for preheating said containers and continuously forwarding said containers directly to said application zone.

17. A method according to claim 16 wherein said means for preheating comprises electric oven means.

18. A method according to claim 1 wherein the average particle diameter of said resin particles is within the range of about 5 to about 10 microns.

19. A method according to claim 1 wherein the resin is a thermosetting epoxy resin.

20. Method for applying an ultra thin resinous coating less than 1 mil in thickness to the entire interior surfaces of a plurality of thin-walled, cylindrical, metal beverage containers, each having an open end, cylindrical sidewalls and a closed end, comprising:

heating each container until at least its bottom is above the softening point of a selected resin;

moving the thus heated containers in sequence through an application zone, and while each container is in said application zone, and said bottom is above the softening point of said resin, introducing at least one pulse of said resin in finely divided solid form wherein the maximum diameter of individual particles is less than about 20 microns, said resin being suspended in a carrier gas, approximately axially toward the closed end of said container through the open end of said container from a region outside the container at a velocity sufficient to project particles of resin to the bottom of said container, thereby to cover substantially the entire interior surface of said container with a resinuous coating;

moving the containers in sequence from said application zone and curing said coating into an adherent, solventfree, substantially continuous film; wherein sufficient tribo-electric charge is imposed on said resin particles prior to their introduction into said container to promote adherence of said particles on said sidewalls.

21. A method according to claim 20 wherein said pulse is created by directing the discharges from a pair of nozzles so that they intersect at the open end of the container at approximately its center.

22. A method according to claim 20 wherein at least two pulses of resin are so directed in said application zone prior to curing said coating.

23. A method according to claim 20 wherein the container is heated so that at the time said pulse is introduced, the interior surface at the bottom of the container is above the softening point of the resin and the interior surface of the sidewall of the container is below the softening point of said resin.

24. A method according to claim 23 wherein said pulse is directed toward the bottom of the container along approximately the center axis of the container so that a portion of the resin particles adhere to the bottom and the remainder of the resin particles are forced out towards the side walls and then along said side walls towards the open top of the container.

25. A method according to claim 24 wherein a first said pulse is followed by a second said pulse before said coating is cured.

26. A method according to claim 25 wherein said pulse is created by directing the approximately simultaneous discharges from a pair of nozzles into each other at a region outside the container and at approximately the center axis of said container.

27. Method for applying a resinous coating less than 1 ml thick to the entire interior surface of a thinwalled, cylindrical, metal beverage container having an open top, cylindrical sidewalls and a bottom, said bottom including an annular moat region adjacent said sidewalls, comprising:

preheating said container so that the temperature of its bottom is above the softening point of a selected resin;

indexing a source of said resin outside the container with respect to the central axis of said container, and while the container is thus indexed and the bottom of the container is above said temperature, introducing at least one pulse of said resin approximately axially through the open top and toward the bottom of the container under conditions wherein:

the resin is in powder form with the individual particles rounded and having maximum diameters less than about 20 microns, the resin is entrained in a carrier gas traveling at a velocity such that the velocity of individual particles of resin is sufficient to reach the bottom of the container, the pulse is less than about 50 milliseconds in duration, and the carrier gas and entrained resin are formed in a cloud-like spray pattern to assure coverage of said moat region;

adhering resin to substantially the entire interior surface of said container; and curing said resin into a substantially uniform, solvent-free coating.

28. A method according to claim 27 wherein the sidewalls of the container are between about 80° F. and about 150° F. when said pulse of resin is introduced.

29. A method according to claim 27 wherein a triboelectric charge is imposed on said resin particles prior to introduction of said pulse of resin.

* * * * *